US006949971B2

(12) United States Patent
Jang

(10) Patent No.: US 6,949,971 B2
(45) Date of Patent: Sep. 27, 2005

(54) REFERENCE VOLTAGE GENERATING CIRCUIT FOR OUTPUTTING MULTI-LEVEL REFERENCE VOLTAGE USING FUSE TRIMMING

(75) Inventor: Ji-Eun Jang, Ichon-shi (KR)

(73) Assignee: Hynix Semiconductor Inc. (KR)

( * ) Notice: Subject to any disclaimer, the term of this patent is extended or adjusted under 35 U.S.C. 154(b) by 0 days.

(21) Appl. No.: 10/746,494

(22) Filed: Dec. 23, 2003

(65) Prior Publication Data

US 2005/0024129 A1 Feb. 3, 2005

(30) Foreign Application Priority Data

Jul. 29, 2003 (KR) ..... 10-2003-0052326

(51) Int. Cl.[7] ..... G05F 1/10
(52) U.S. Cl. ..... 327/541; 327/540; 323/316
(58) Field of Search ..... 327/538, 540, 327/541, 543; 323/313, 315

(56) References Cited

U.S. PATENT DOCUMENTS

| | | | | | |
|---|---|---|---|---|---|
| 5,319,345 | A | * | 6/1994 | Abe et al. | 338/201 |
| 5,335,203 | A | * | 8/1994 | Ishii et al. | 327/543 |
| 5,523,721 | A | * | 6/1996 | Segawa et al. | 330/86 |
| 6,011,428 | A | * | 1/2000 | Tsukude et al. | 327/541 |
| 6,078,210 | A | * | 6/2000 | Uchida et al. | 327/530 |
| 6,239,652 | B1 | * | 5/2001 | Oh et al. | 327/541 |
| 6,380,791 | B1 | * | 4/2002 | Gupta et al. | 327/382 |
| 6,445,257 | B1 | | 9/2002 | Cox et al. | |
| 6,492,680 | B1 | | 12/2002 | Ishii et al. | |
| 6,531,914 | B2 | * | 3/2003 | Kawakubo | 327/541 |
| 6,650,173 | B1 | * | 11/2003 | Khouri et al. | 327/538 |
| 2001/0011886 | A1 | * | 8/2001 | Kobayashi | 323/281 |

FOREIGN PATENT DOCUMENTS

| | | |
|---|---|---|
| JP | 03-004187 | 1/1991 |
| JP | 04-362600 | 12/1992 |
| JP | 05-267464 | 10/1993 |
| JP | 06-069444 | 3/1994 |
| JP | 08-274266 | 10/1996 |
| JP | 11-017010 | 1/1999 |
| JP | 2001-053152 | 2/2001 |

* cited by examiner

*Primary Examiner*—Terry D. Cunningham
(74) *Attorney, Agent, or Firm*—Blakely Sokoloff Taylor & Zafman

(57) ABSTRACT

A reference voltage generating circuit includes voltage outputting means for outputting a reference voltage corresponding to a difference between a band gap reference voltage and an input voltage; a first resistor having one end that is coupled to the output of the voltage outputting unit; first variable resistor unit having a plurality of second resistors that are serially coupled between the first resistor and a ground voltage, for providing the input voltage of the voltage outputting unit with a first trimming voltage that is inputted to one end of selected one of the plurality of the second resistors in response to decoded signals for trimming the reference voltage; second variable resistor having a plurality of third resistors coupled serially between the first resistor and the ground voltage, the third resistors having different resistances from the second resistors, for providing the input voltage of the voltage outputting unit with a second trimming voltage that is inputted to one end of selected one of the plurality of the third resistors in response to the decoded signals for trimming the reference voltage; and selecting unit for selectively providing the first trimming voltage or the second trimming voltage to the input voltage of the voltage outputting unit.

12 Claims, 10 Drawing Sheets

$$Vref = Vbg \times (1 + Ra/Rb)$$

REFERENCE VOLTAGE GENERATING CIRCUIT FOR OUTPUTTING MULTI-LEVEL REFERENCE VOLTAGE USING FUSE TRIMMING

FIELD OF THE INVENTION

The present invention relates to a semiconductor memory device; and, more particularly, to a reference voltage generating circuit for outputting a reference voltage of a predetermined level in a memory device.

BACKGROUND OF THE INVENTION

As a semiconductor memory device gets integrated further and further, internal voltages of various voltage levels are used inside the memory such that a separate voltage is used for a core region or a higher voltage is used for over-driving operation of high speed data access, in order to reduce power consumption. A reference voltage generating circuit is to output a reference voltage for generating multi-level internal voltages for use in the memory device.

Typically, a supply voltage that is supplied from outside to the memory device include variation in its voltage level. A band gap reference circuit is used to output a voltage that keeps a constant level even if it happens variation in the supply voltage. The reference voltage generating circuit uses the output voltage that is outputted from the band gap reference circuit to generate the voltage that is referenced to produce the internal voltages that are needed for the internal operations.

FIG. 1 provides a block diagram for generating an internal voltage in a typical memory device.

Referring to FIG. 1, for generating the internal voltages in the memory device, there is included a band gap reference circuit 10, a reference voltage generating circuit 20, a reference voltage adjusting fuse unit 40 and an internal voltage supplying unit 30.

The band gap reference circuit 10 receives an external voltage VDD to output a band gap reference voltage Vbg of a constant level regardless of variation of the external voltage VDD. The reference voltage generating circuit 20 uses the band gap reference voltage Vbg that is outputted from the band gap reference circuit 10 to generate a reference voltage Vref having a predetermined level. The reference voltage adjusting fuse unit 40 adjusts the voltage level of the reference voltage Vref that is outputted from the reference voltage generating circuit 20. The internal voltage supplying unit 30 receives the reference voltage Vref from the reference voltage generating circuit 20 to generate various internal voltages Vcore, Vperi, Vpp, Vbb for use in the operation of the memory device.

Here, 'Vcore' is an internal voltage for use in the core region having unit cells in the memory device, 'Vperi' is an internal voltage for use in the peripheral region from the core region in the memory device, 'Vpp' is an internal voltage that is used when a higher voltage is needed for over-driving operation, and 'Vbb' is an internal voltage of a lower level than a ground voltage VSS, which is used as a board bias supply voltage in the core region.

FIG. 2 is a circuit diagram of the reference voltage generating circuit 20 and the reference voltage adjusting fuse unit 40 in FIG. 1.

Referring to FIG. 2, the reference voltage adjusting fuse unit 40 includes a fuse box 41 and a fuse decoder 42. The fuse box 41 has a number of fuses and outputs control codes F0–F2, F0*b*–F2*b* that are coded by selective short of the fuses. The fuse decoder 41 decodes the control codes F0–F2, F0*b*–F2*b* to output decoded signals TRIM0–TRIM7.

The reference generating circuit 20 includes a variable resistor unit 22 and an operational amplifier 21. The variable resistor unit 22 varies its resistance in response to the decoded signals TRIM0–TRIM7 that are outputted from the fuse decoder 41. The operational amplifier 21 receives the band gap reference voltage Vbg as its positive input to output the reference voltage Vref.

The variable resistor unit 22 has a resistor R1, a number of resistors R2_1–R2_8, and a number of switching MOS transistors MN1–MN11. One end of the resistor R1 is coupled to the output of the operational amplifier 21 that outputs the reference voltage Vref based on the decoded signals TRIM0–TRIM7. The resistors R2_1–R2_8 are serially coupled between the other end of the resistor R1 and the ground voltage VSS. The switching MOS transistors MN1–MN11 connect a node x to one end of the selected one of the resistors R2_1–R2_8 based on the decoded signals TRIM0–TRIM7.

The operational amplifier 20 includes a diode-coupled MOS transistor MP2, a PMOS transistor MP1, an NMOS transistor MN1, an NMOS transistor MN2, an NMOS transistor MN3 and a PMOS transistor MP3. The diode-coupled MOS transistor MP2 has one end that is coupled to the supply voltage VDD, and a gate that is coupled to the other end of the MOS transistor MP2. The PMOS transistor MP1 has one end that is coupled to the supply voltage VDD, and a gate that is coupled to the gate of the PMOS transistor MP2 to form a current mirror. The NMOS transistor MN1 has one end that is coupled to the other end of the PMOS transistor MP1, and a gate that receives the band gap reference voltage Vbg. The NMOS transistor MN2 has one end that is coupled to the other end of the PMOS transistor MP2 and a gate that receives the voltage Vbg_ref that is inputted to the node x. The NMOS transistor MN3 has one end that is coupled to the other ends of the NMOS transistor MN1, MN2, the other end that is coupled to the ground voltage VSS, and a gate that receives the band gap reference voltage Vbg. And, the PMOS transistor MP3 has one end that is coupled to the supply voltage VDD, a gate that is coupled to the one end of the NMOS transistor MN1, and the other end that outputs the reference voltage Vref.

FIG. 3 describes a circuit diagram of the fuse box 41 in FIG. 2.

Referring to FIG. 3, the fuse box 41 includes 3 fuse sets 41*a*, 41*b*, 41*c* for outputting the 6-bit coded signals F0–F2, F0*b*–F2*b*.

One of the fuse sets 41*a* includes a PMOS transistor MP4, a fuse f1, a NMOS transistor MN12, and inverters I11, I12, I13. The PMOS transistor MP4 has one end that is coupled to the supply voltage VDD, and a gate that is coupled to the ground voltage to keep a turn-on state. The fuse f1 has one end that is coupled to the other end of the PMOS transistor MP4. The inverter I1 has its input that is coupled to the other end of the fuse f1. The NMOS transistor MN12 connects the other end of the fuse f1 to the ground voltage VSS and has a gate that receives the output of the inverter I1. The inverter I12 inverts the output of the inverter I1 to output the coded signal F0. The inverter I13 inverts the output of the inverter I12 to output the coded signal F0*b*. Also, the other fuse sets 41*b*, 41*c* are constituted as similar to the fuse set 41*a* so as to output the coded signals F1, F1*b* and the coded signals F2, F2*b*, respectively.

FIG. 4 shows a circuit diagram of the fuse decoder 42 in FIG. 2.

Referring to FIG. 4, the fuse decoder 42 includes a number of NAND gates ND1–ND8 for receiving three different signals among the coded signals F0–F2, F0*b*–F2*b* that are outputted from the fuse box 41, respectively, and a number of inverters I10–I17 for inverting the outputs of the NAND gates ND1–ND8, respectively, to output the decoded signals TRIM0–TRIM7.

It will be described for the operation of internal voltage generating in the memory device with reference to the FIG. 1 to FIG. 4.

First, the band gap reference circuit 10 receives the supply voltage VDD and ground voltage VSS that are provided from outside and outputs the band gap reference voltage that keeps its level constantly regardless of variation in the voltage level of the external voltage VDD.

Typically, the supply voltage that is provided from outside of the band gap device is unstable to have variation in its voltage level. Therefore, the band gap reference circuit 10 generates the band gap reference voltage Vbg of a constant level regardless of the variation of the voltage level of the external voltage to prevent the voltage level variation of the external voltage from being transferred to the internal circuits.

In turn, the reference voltage generating circuit 20 receives the band gap reference voltage Vbg to output the reference voltage of a predetermined voltage. The internal voltage supplying unit 30 uses the reference voltage Vref to generate the internal voltages Vcore, Vperi, Vpp, Vbb to use in the internal operations in the memory device.

At that time, the reference voltage Vref that is outputted from the reference voltage generating circuit 20 is a trimmed voltage that is trimmed by the decoded signals TRIM0–TRIM7 that are outputted from the reference voltage adjusting fuse unit 40.

The reference voltage Vref from The reference voltage generating circuit 20 is an important signal that is a reference for the internal voltage supplying unit 30 to generate the various internal voltages for use in the internal operations.

However, in actual process, the reference voltage Vref is not generated as having a designed voltage level due to various process variables in most cases.

To solve this problem, the memory device employs the reference voltage adjusting fuse unit 40 having a number of fuses. The decoded signals TRIM0–TRIM7 are generated by selectively making the fuses of the reference voltage adjusting fuse unit 40 short in wafer level and, in turn, the reference voltage generating circuit 20 adjusts the voltage level of the reference voltage Vref in response to the decoded signals TRIM0–TRIM7.

Further, it will be described for the steps of generating the decoded signals TRIM0–TRIM7 in the reference voltage adjusting fuse unit 40.

First, the fuse box 41 includes a number of the fuse sets 41*a*, 41*b*, 41*c* corresponding to the number of bits of the outputted coded signals F0–F2, F0*b*–F2*b*. When the reference voltage Vref that is measured at the wafer level is not equal to the desired one, the fuses f1, f2, f3 of the fuse boxes 41 are selectively radiated with a laser to code the coded signals F0–F2, F0*b*–F2*b*. The fuse decoder 42 receives the coded signals F0–F2, F0*b*–F2*b* to activate one of the 8 decoded signals TRIM0–TRIM7 to a high level.

In turn, one of the switching MOS transistors MN4–MN11 is turned on by the decode signals TRIM0–TRIM7 and, accordingly, one end of one of the serially coupled resistors R2_1–R2_8 is connected to the node x. Depending on the resistor that is connected to the node x among the resistors R2_1–R2_8, the reference voltage Vref is adjusted and outputted.

FIG. 5 represents an equivalent circuit diagram for illustrating the voltage level of the reference voltage Vref that is outputted from the reference voltage generating circuit 20 in FIG. 2.

As shown in FIG. 5, when the operational amplifier 21 receives the band gap reference voltage Vbg to its positive input, resistors Ra, Rb are serially coupled between the output of the operational amplifier 21 and the ground voltage VSS, and the operational amplifier 21 receives the voltage on the node x to its negative input, the voltage level of the reference voltage Vref that is outputted from the output of the operation amplifier 21 becomes Vref=Vbg×(1+Ra/Rb).

Here, the resistances of the resistors Ra, Rb are determined by the decoded signals TRIM0–TRIM7 in the reference generating circuit in FIG. 2. For example, when the decoded signal TRIM3 is activated and inputted, the resistance of the resistor Ra is a sum of R2_1–R2_3 and that of the resistor Rb is a sum of R2_4–R2_8.

By the way, in some semiconductor devices, there happens too large error between the designed reference voltage Vref and the actually outputted reference voltage to trim with only the 8 resistors R2_1–R2_8 shown in FIG. 2. In such a case, more than 8 resistors R2_1–R2_8 should be serially coupled.

In that case, the number of the switching MOS transistors increases depending on the extra serially-coupled resistors. Further, as the number of the decoded signal increases, the fuse decoder 42 and the fuse box 41 for outputting the decoded signals increases so much that the area of the integrated circuit should be increased.

For example, when the designed reference voltage is 1.6V and the voltage that is outputted at a test on the wafer is 1.8V, the number of the required resistors is 20 assuming that the voltage level that can be adjusted by one resistor is 0.01. Accordingly, the fuse decoder and the fuse box get complicated.

Here, if each resistor is chosen to have a lager resistance, the number of the resistors can be reduced but the fuse trimming operation cannot be adjusted finely. For example, when the adjustable voltage of each resistor is raised to 0.4V, 5 resistors are enough for the variable resistor unit but the reference voltage that can be adjusted in the fuse trimming operation is to limited to 1.8, 1.76, 1.72, making fine trimming of the reference voltage impossible.

Because process variables are not likely to be set for a just developed product during the semiconductor development, the range of the voltage trimming is wide. However, once the semiconductor is finally developed, the voltage trimming should be performed finely. Therefore, to let fine trimming whiling keeping some trimming range, the number of the resistors is to increase.

SUMMARY OF THE INVENTION

It is, therefore, a primary object of the present invention to provide a reference voltage generating circuit capable of trimming a reference voltage to various voltage levels with minimum number of resistors that are required to trim the voltage level.

In accordance with the present invention, there is provided a reference voltage generating circuit including a voltage outputting unit for outputting a reference voltage corresponding to a difference between a band gap reference voltage and an input voltage; a first resistor having one end that is coupled to the output of the voltage outputting unit; a first variable resistor unit having a plurality of second resistors that are serially coupled between the first resistor and a ground voltage, for providing the input voltage of the voltage outputting unit with a first trimming voltage that is inputted to one end of selected one of the plurality of the second resistors in response to decoded signals for trimming the reference voltage; a second variable resistor unit having a plurality of third resistors coupled serially between the first resistor and the ground voltage, the third resistors having different resistances from the second resistors, for providing the input voltage of the voltage outputting unit with a second trimming voltage that is inputted to one end of selected one of the plurality of the third resistors in response to the decoded signals for trimming the reference voltage; and a selecting unit for selectively providing the first trimming voltage or the second trimming voltage to the input voltage of the voltage outputting unit.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, with reference to the accompanying drawings, a preferred embodiment of the present invention will be explained in detail.

Figure 6:
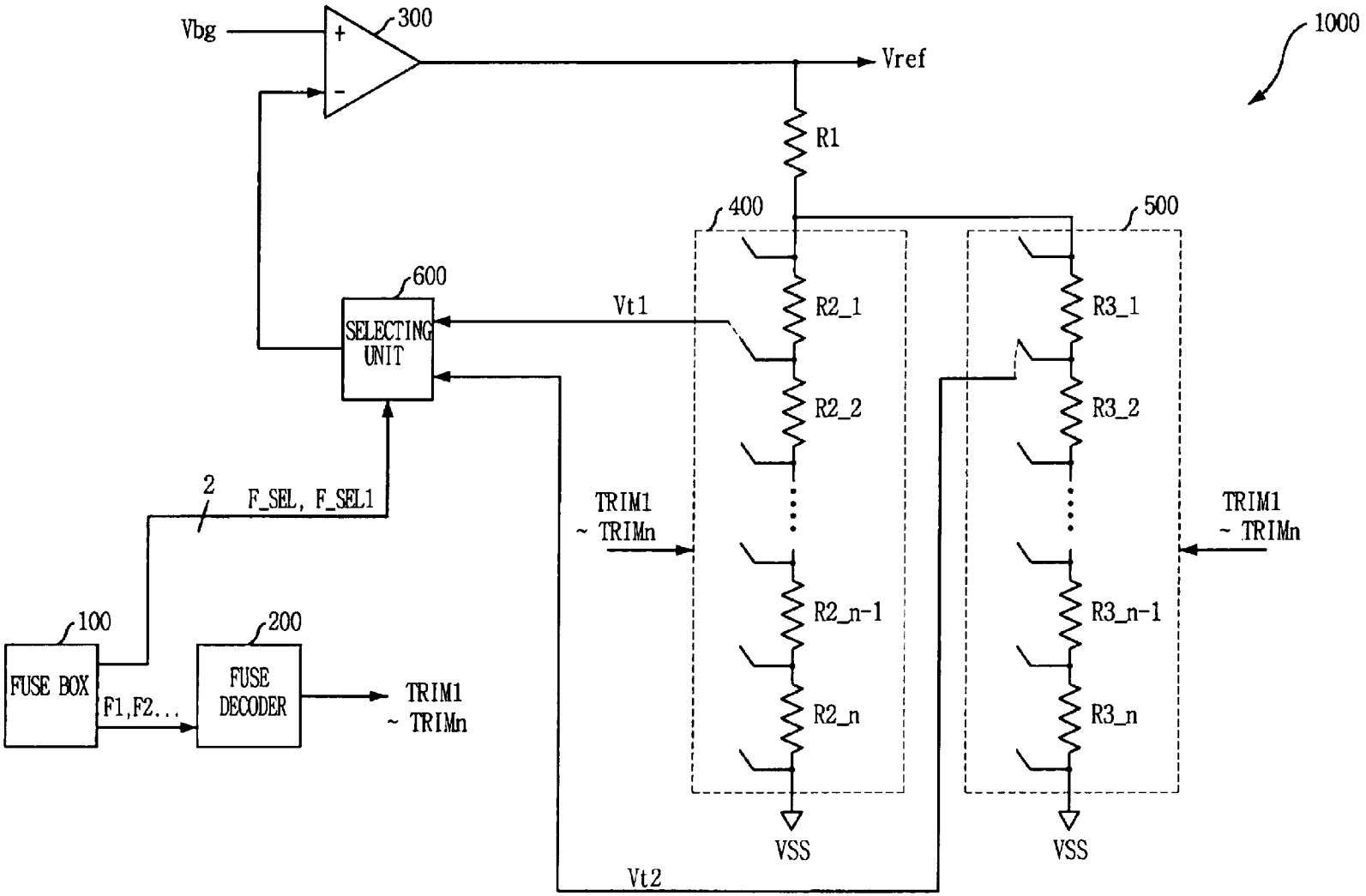
FIG. 6 illustrates a block diagram of a reference voltage generating circuit of the present invention.

FIG. 6 illustrates a block diagram of a reference voltage generating circuit of the present invention.

Referring to FIG. 6, the reference voltage generating circuit 1000 comprises an operational amplifier 300, a first variable resistor unit 400, a second variable resistor unit 500 and a selecting unit 500. The operational amplifier 300 receives a band gap reference voltage Vbg to its positive input (+) and outputs a reference voltage Vref. The first variable resistor unit 400 has a resistor R1 having one end that is coupled to the output of the operational amplifier 300, and a plurality of resistors R2_1–R2_*n* that are serially coupled between the resistor R1 and a ground voltage VSS for providing the negative input of the operational amplifier 300 with a first trimming voltage Vt1 that is inputted to one end of selected one of the plurality of the resistors R2_1–R2_n in response to decodes signals TRIM1–TRIMn for trimming the reference voltage Vref. The second variable resistor unit has a plurality of resistors R3_1–R3_n coupled serially between the resistor R1 and the ground voltage and having different resistances from the resistor R1, for providing the negative input of the operational amplifier 300 with a second trimming voltage Vt2 that is inputted to one end of selected one of the plurality of the resistors R3_1–R3_n, e.g., the resistor R3_2, in response to the decoded signals TRIM1–TRIMn for trimming the reference voltage Vref. The selecting unit selectively provides the first trimming voltage Vt1 or the second trimming voltage Vt2 to the negative input of the operational amplifier 300.

Here, the plurality of the resistors R3_1–R3_n in the second variable resistor unit 500 have 1/10–1/5 resistances compared to those of the first variable resistor unit 400.

Also, the reference generating unit 1000 of the present invention further comprises a fuse box 100 having a number of fuses for outputting coded signals F0, F1, . . . that are coded by selectively blowing the fuses out, and a fuse decoder 200 for decoding the coded signals F0, F1, . . . from the fuse box 100 to output the decoded signals TRIM1–TRIMn.

Figure 7:
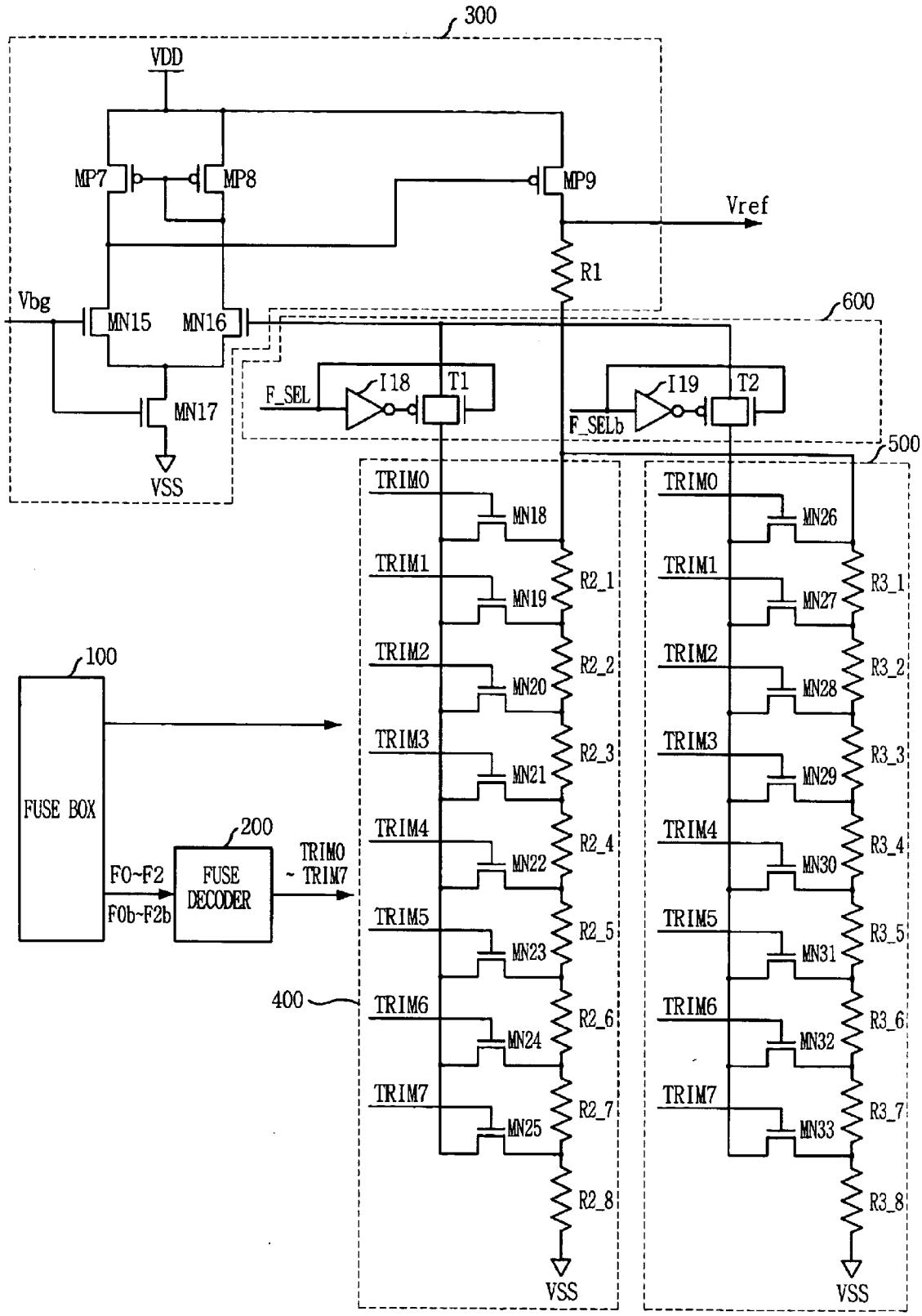
FIG. 7 shows a circuit diagram of an embodiment of the reference voltage generating circuit in FIG. 6.

FIG. 7 shows a circuit diagram of an embodiment of the reference voltage generating circuit in FIG. 6.

The reference voltage generating circuit shown in FIG. 7 includes 8 resistors in each of the first and the second resistor units and, therefore, 8 decoded signals TRIM–TRIM8 are required. Here, the fuse box 100 includes 3 fuses to generate the coded signals F0–F2, F0*b*–F2*b*.

Referring to FIG. 7, the operational amplifier 300 of the present invention includes a diode-coupled PMOS transistor MP8 having one end coupled to a supply voltage VDD, and a gate coupled to the other end, a PMOS transistor MP7 having one end coupled to the supply voltage VDD, and a gate coupled to the gate of the PMOS transistor MP8 to form a current mirror with the first PMOS transistor MP8, an NMOS transistor MN15 having a gate for receiving the band gap reference voltage Vbg, and the other end coupled to the other end of the PMOS transistor MP7, an NMOS transistor MN16 having one end coupled to the other end of the PMOS transistor MP8, and a gate for receiving a signal that is provided from the selecting unit 600, an NMOS transistor MN17 connecting the other ends of the NMOS transistors MN15, MN16 to the ground voltage VSS and having a gate for receiving the band gap reference voltage Vbg, and a PMOS transistor MP9 having one end coupled to the supply voltage VDD, a gate for receiving the voltage that is inputted to the one end of the NMOS transistor MN15, and the other end for outputting the reference voltage Vref.

Also, the selecting unit 600 includes a transfer gate T1 turned on in response to a high level of a selection signal F_SEL for transferring the first trimming voltage Vt1 to the negative input of the operational amplifier 300, and a transfer gate T2 turned on in response to a high level of the selection signal F_SEL for transferring the second trimming voltage Vt2 to the negative input of the operational amplifier 300.

Also, the reference voltage generating circuit of the present invention includes the resistor R1 between the output of the operational amplifier 300 and the first and the second variable resistor units 400, 500.

Also, the first variable resistor unit 400 includes the plurality of the resistors R2_1–R2_8 coupled serially between the resistor R1 and the ground voltage VSS, and a plurality of switching MOS transistors MN18–MN25 turned on in response to the one-bit signal of the decoded signals TRIM0–TRIM7 for providing the one end of each of the plurality of the resistors R2_1–R2_8 with the first trimming voltage Vt1.

Also, the second variable resistor unit 500 includes a number of the resistors R3_1–R3_8 serially coupled between the resistor R1 and the ground voltage VSS, and a number of switching MOS transistors MN26–MN33 turned on in response to the one-bit signal of the decoding signals TRIM0–TRIM7 for providing the one end nodes of the resistors R3_1–R3_8 with the second trimming voltage Vt2.

Figure 8:
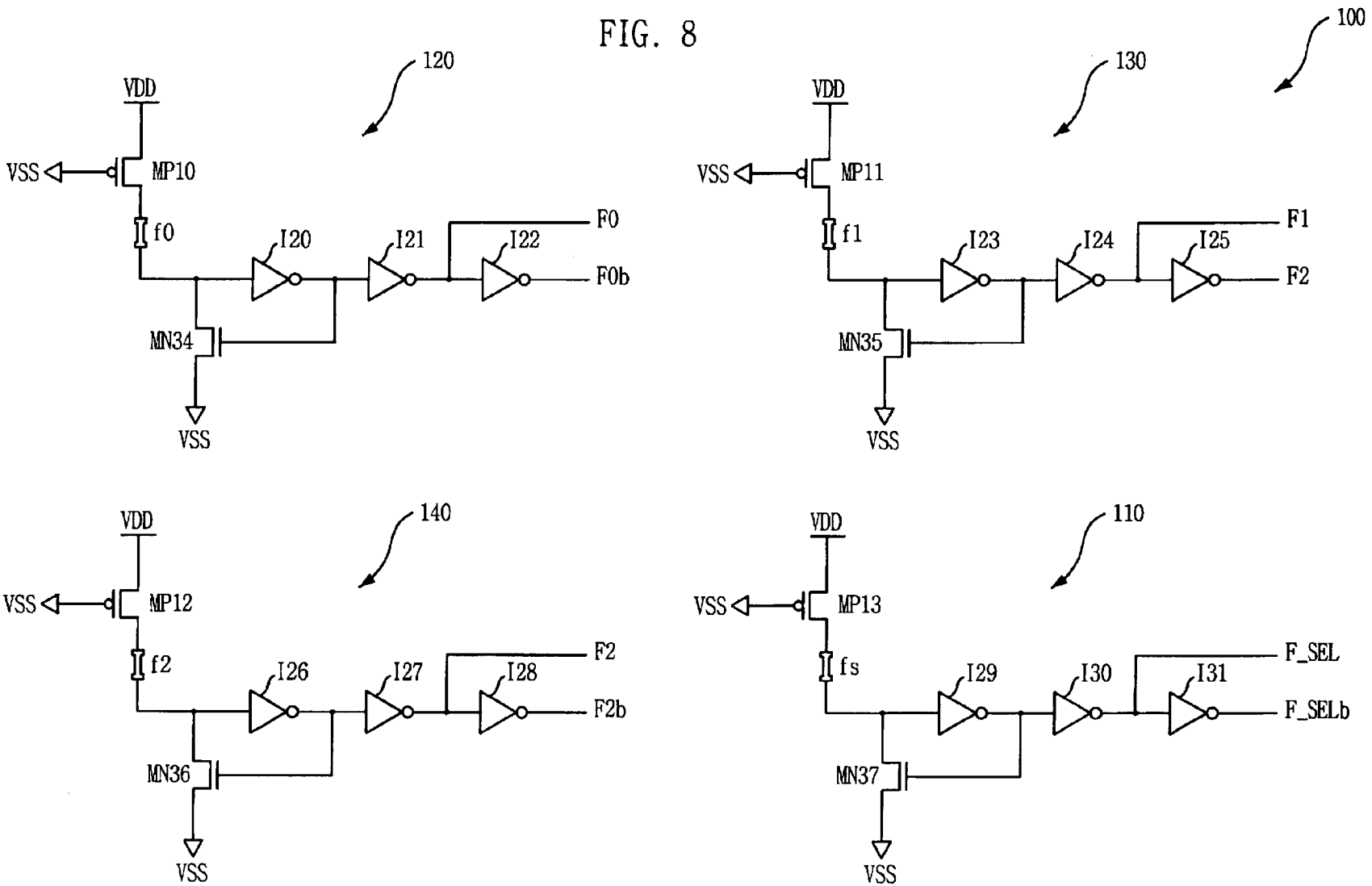
FIG. 8 provides a circuit diagram of a fuse box in FIG. 6.

FIG. 8 provides a circuit diagram of the fuse box 100 in FIG. 6.

Referring to FIG. 8, the fuse box 100 includes a first unit fuse set 110 having a selection fuse fs for outputting the selection signal F_SEL, F_SELb to select the first trimming voltage Vt1 or the second trimming voltage Vt2 in the selecting unit 600 depending on the blowing out of the selection fuse fs, and a plurality of second unit fuse sets 120–140, each having a corresponding one of coding fuses F0–F2, for outputting a two-bit signal of the coded signals F0–F2, F0*b*–F2*b* depending on the blowing out of the coding fuses F0–F2, F0*b*–F2*b*, respectively.

Also, The first unit fuse set 110 includes a PMOS transistor MP13 having one end coupled to the supply voltage VDD, a gate receiving the ground voltage VSS, and the other end coupled to the selection fuse, an inverter I29 having an input coupled to the other end of the selection fuse fs, an NMOS transistor MN37 connecting the other end of the selection fuse fs to the ground voltage VSS and having a gate for receiving the output voltage of the inverter I29, an inverter I30 for inverting the output signal of the inverter I29 to output the selecting signal F_SEL for selecting the first trimming voltage Vt1 in the selecting unit 600, and an inverter I31 for inverting the output of the inverter I30 to output the selecting signal F_SELb for selecting the second trimming voltage Vt2 in the selecting unit 600.

The second unit fuse set 120 includes a PMOS transistor MP10 having one end coupled to the supply voltage VDD, and a gate for receiving the ground voltage VSS, a coding fuse f0 coupled to the other end of the PMOS transistor MP10, an inverter I22 having an input coupled to the other end of the coding fuse f0, an NMOS transistor MN34 connecting the other end of the coding fuse f0 to the ground voltage VSS and having a gate for receiving the output voltage of the inverter I20, an inverter I21 for inverting the output signal of the inverter I21 for outputting a first coding signal that is one bit of the coding signals F0–F2, F0*b*–F2*b*, and an inverter I22 for inverting the output of the inverter I21 for outputting a coding signal F0*b* that is inverted version of the first coding signal F0.

Figure 9:
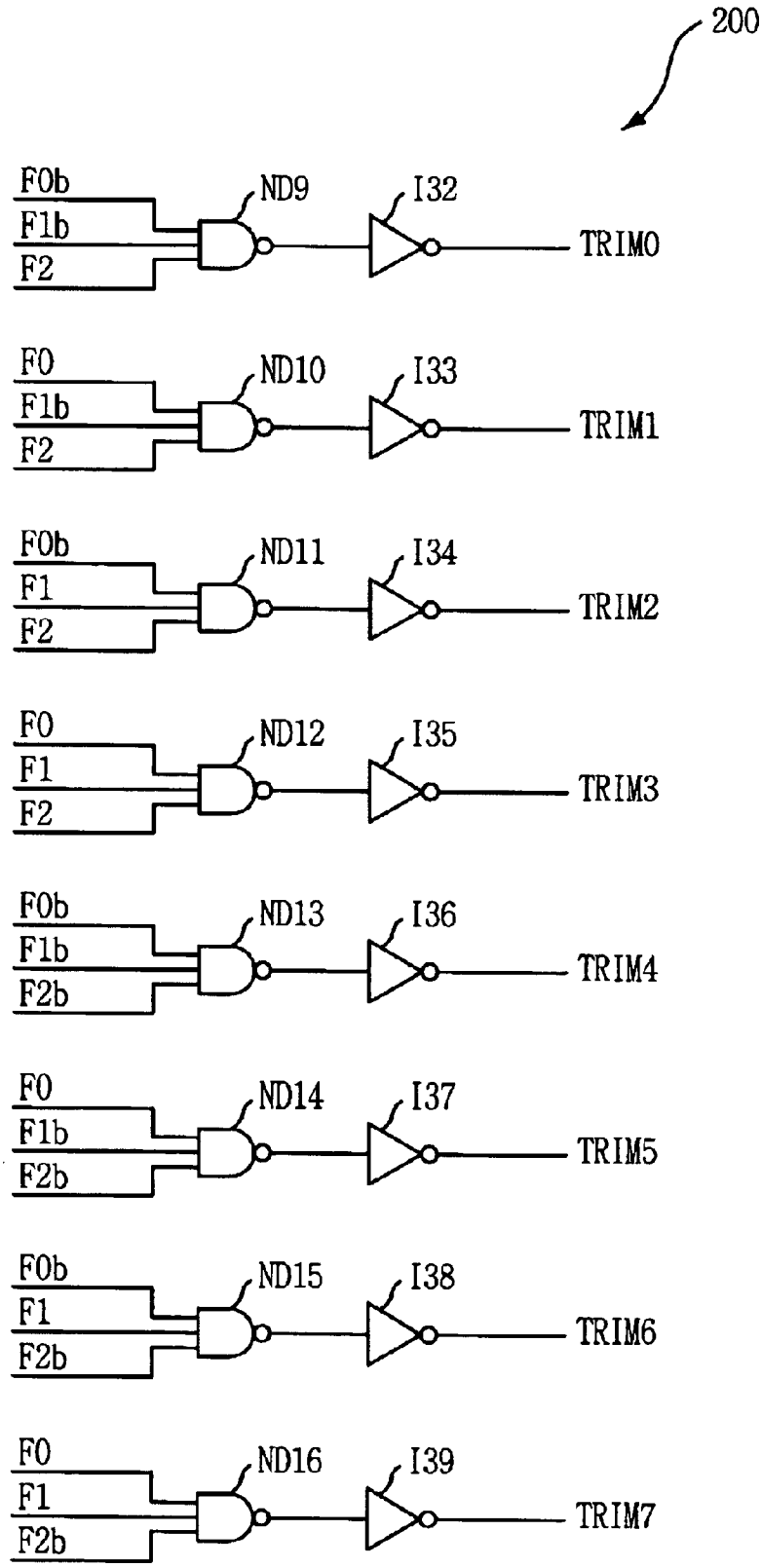
FIG. 9 offers a circuit diagram of a fuse decoder in FIG. 6.

FIG. 9 offers a circuit diagram of the fuse decoder 200 in FIG. 6.

Referring to FIG. 9, the fuse decoder 200 includes a plurality of logic AND gates, each for receiving a corresponding signal from the plurality of the second fuse sets 120–140, that is selected from the coding signals F0, F0*b* that are outputting from one of the second fuse sets, e.g., 110, and for outputting a one-bit signal of the decoded signals TRIM0–TRIM7.

For example, in order to output the one-bit signal TRIM0 among the decoded signals TRIM0–TRIM7, the second unit fuse sets 120–140 receive the corresponding one of the coded signals F0*b*, F1*b*, F2. Here, the inputted coded signals F0*b*, F1*b*, F2 are selected from 2 coded signals from one of the second unit fuse sets.

It will described for the operation of the reference voltage generating circuit in accordance with one embodiment of the present invention with reference to FIG. 7 to FIG. 10.

The reference voltage generating circuit receives the band gap reference voltage Vbg to output the reference voltage Vref having a predetermined level. As described above, the reference voltage Vref that is outputted from the reference voltage generating circuit is the important voltage for generating the internal voltages that are used for internal operation of the semiconductor device such as memory device. Accordingly, it is essential for the operation of the semiconductor device to have the voltage level of the reference voltage Vref from the reference voltage generating circuit as desired when designed, upon the semiconductor device is manufactured.

The reference voltage Vref that is outputted from the reference voltage generating circuit in wafer state is measured and then compared with the reference voltage that is desired when designed. If the two reference voltages are different from each other, trimming operation is performed to correct the voltage level of the reference voltage Vref.

As shown in FIG. 7, the reference voltage generating circuit according to this embodiment comprises the first and the second variable resistor units 400, 500 for adjusting the reference voltage Vref with the trimming operation. On the other hand, the fuse box 100 outputs the selection signals F_SEL, F_SELb and, depending on the selection signals F_SEL, F_SELb, one of the first and the second variable resistor units 400, 500 is selected.

Each of the first and the second variable resistor units 400, 500 includes 8 resistors serially coupled between the resistor R1 and the ground voltage VSS, respectively. Here, the resistances of the resistors included in the first variable resistor unit 400 are different from the resistors included in the second variable resistor unit 500.

For example, when the reference voltage Vref is to be changed by 0.1V with one of the resistors in the first variable resistor unit 400, the reference voltage Vref is to be changed by 0.01V with one of the resistors in the second variable resistor unit 500.

In turn, the fuse decoder 200 decodes the coded signals F0–F2, F0*b*–F2*b* that are outputted from the fuse box 100 and activates one of the decoded signals TRIM0–TRIM7, e.g., TRIM2, to the high level to output.

Figure 1:
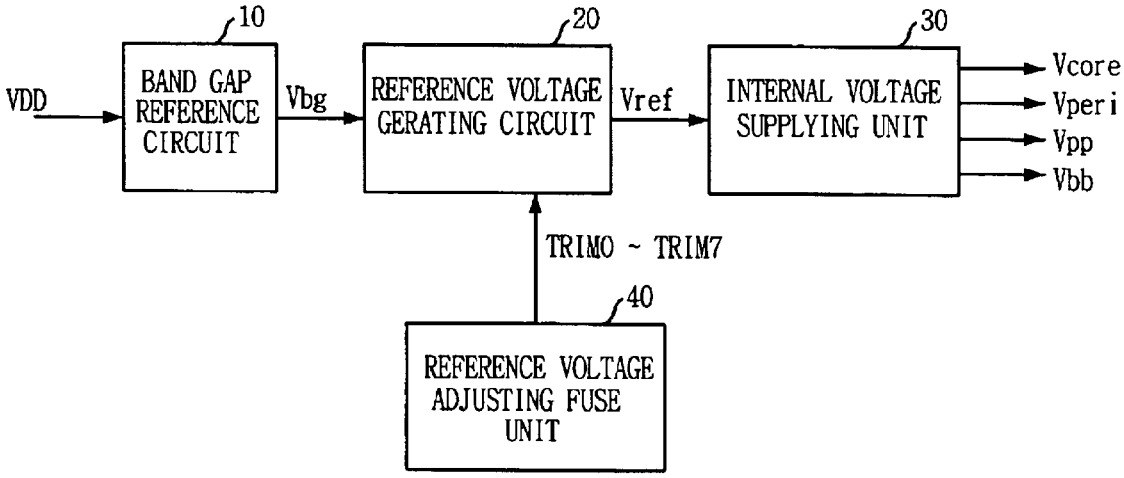
FIG. 1 (PRIOR ART)
FIG. 1 provides a block diagram for generating an internal voltage in a typical memory device.
Figure 2:
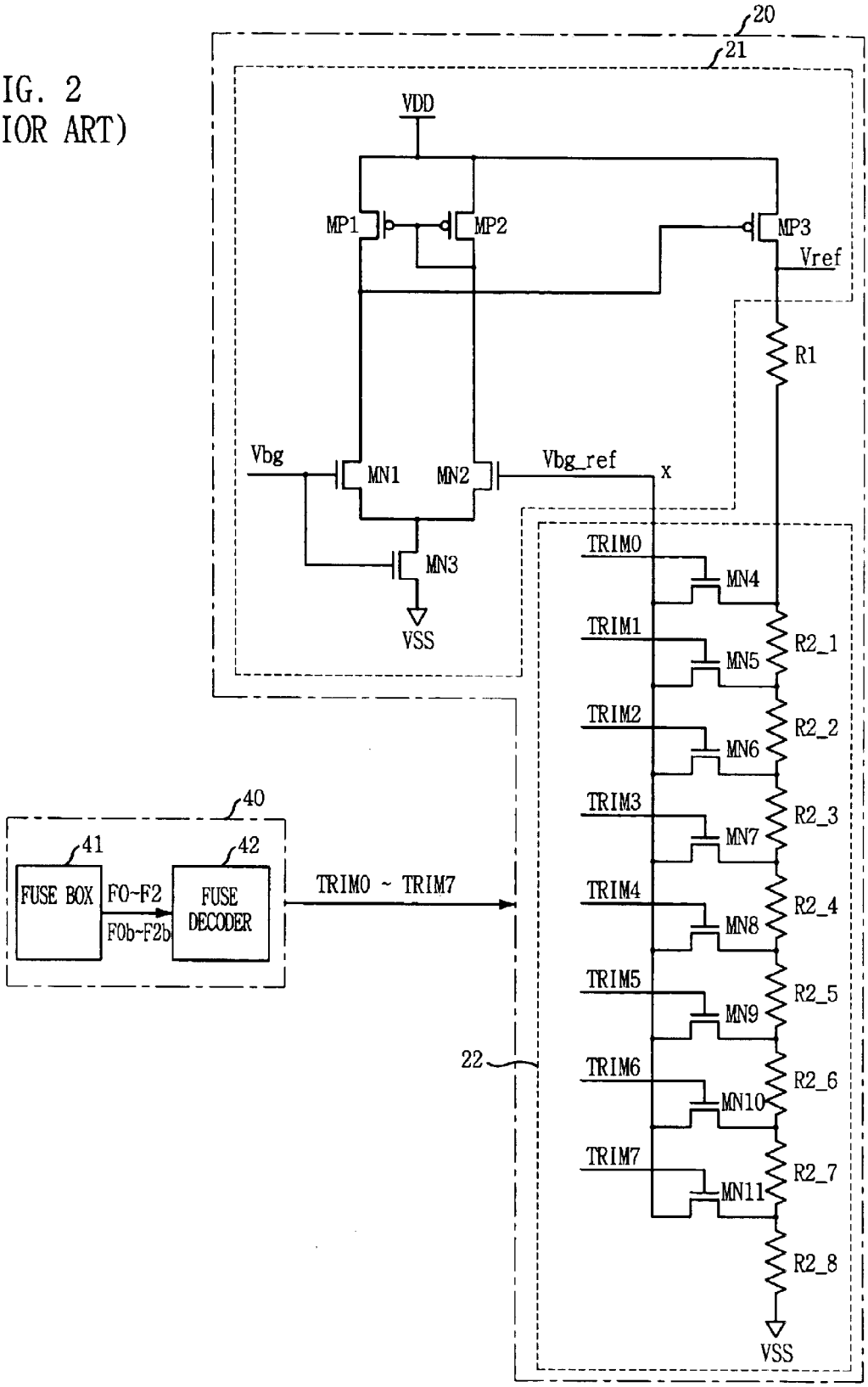
FIG. 2 (PRIOR ART)
FIG. 2 is a circuit diagram of a reference voltage generating circuit and a reference voltage adjusting fuse unit in FIG. 1.
Figure 3:
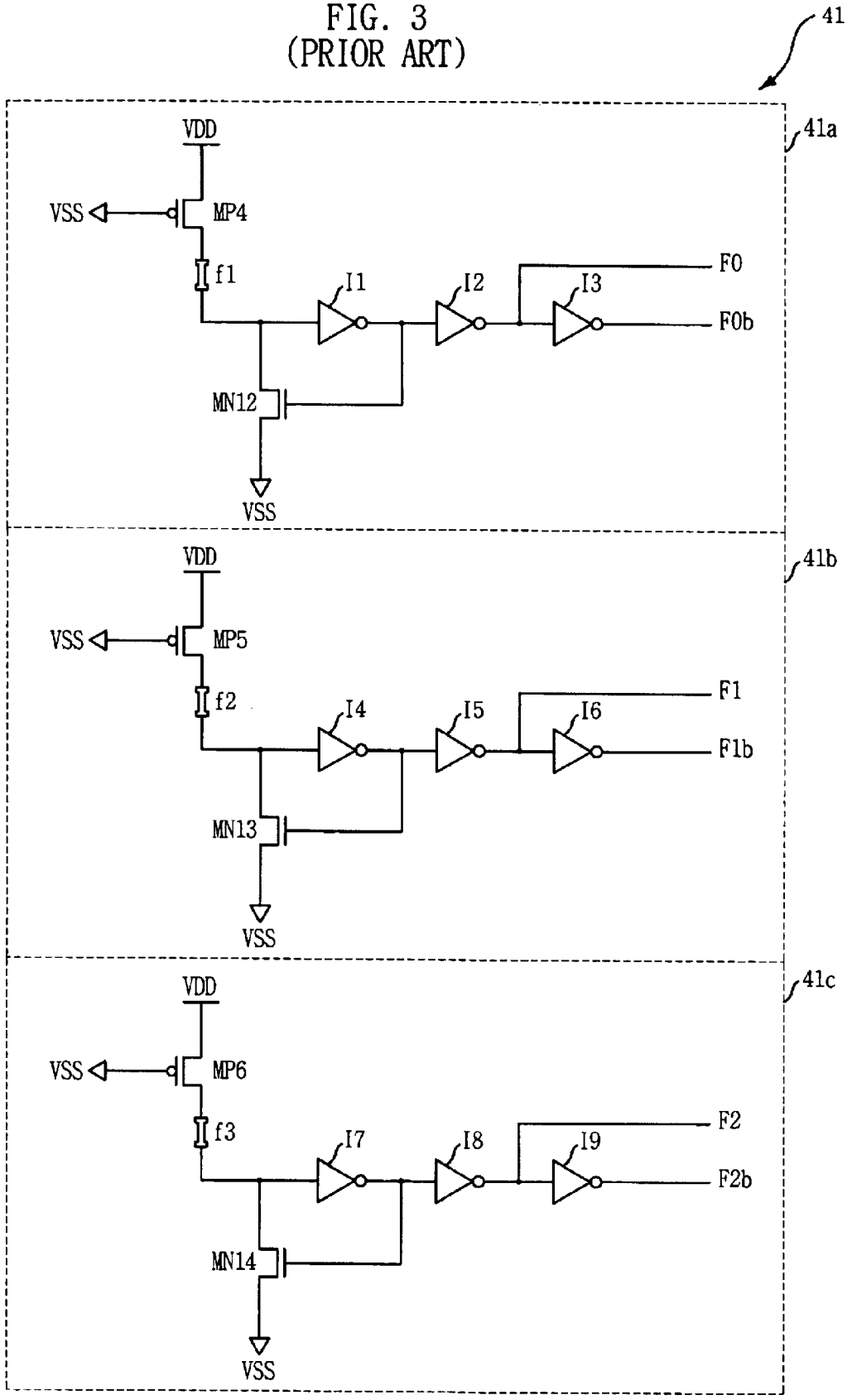
FIG. 3 (PRIOR ART)
FIG. 3 describes a circuit diagram of a fuse box in FIG. 2.
Figure 4:
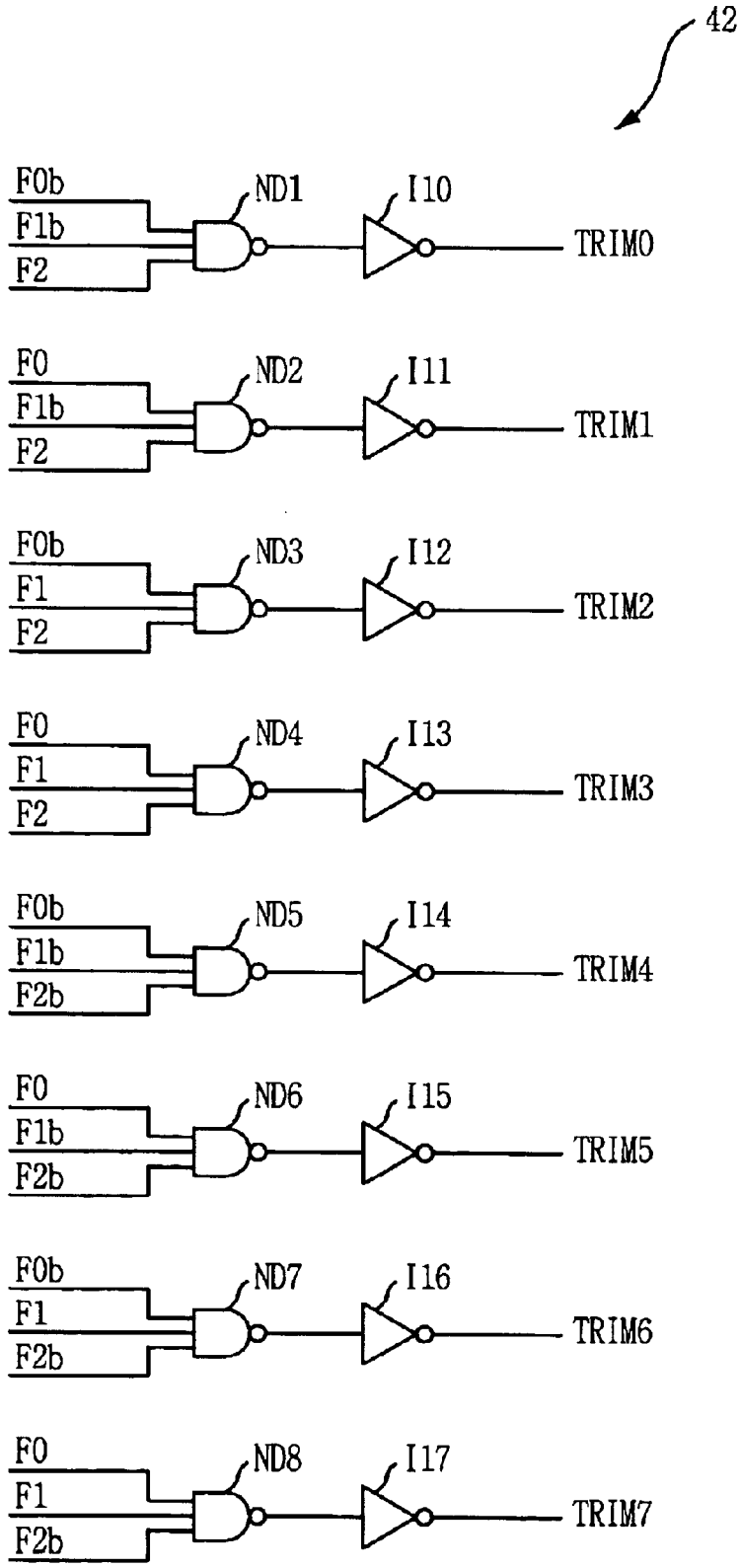
FIG. 4 (PRIOR ART)
FIG. 4 shows a circuit diagram of a fuse decoder in FIG. 2.
Figure 5:
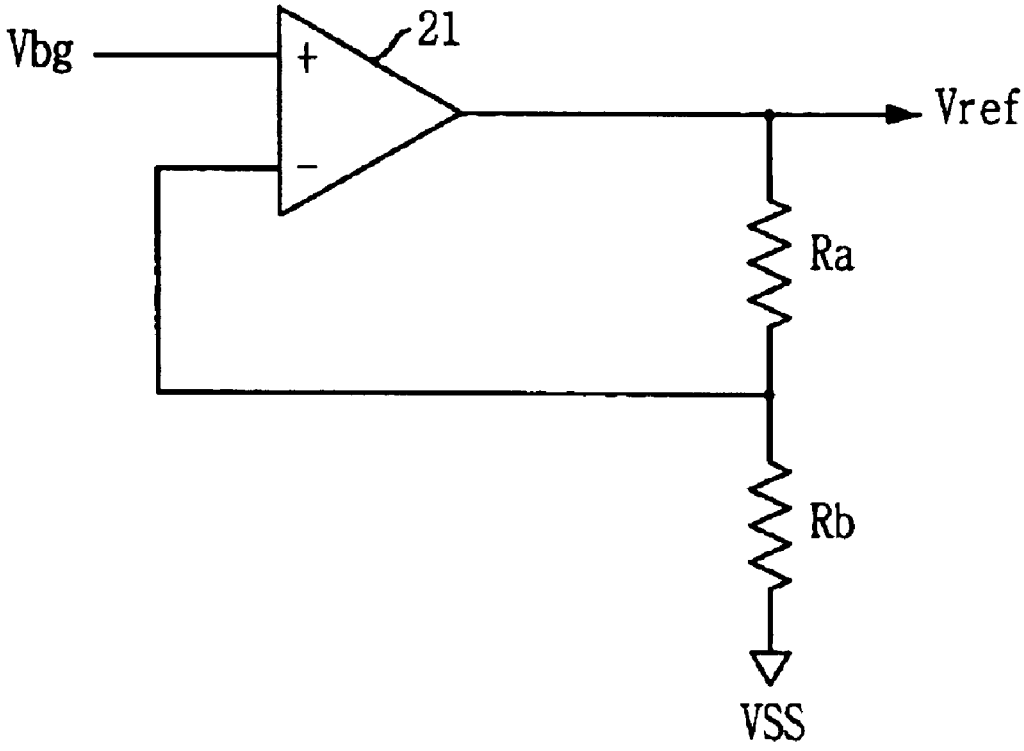
FIG. 5 (PRIOR ART)
FIG. 5 represents an equivalent circuit diagram for illustrating the voltage level of the reference voltage that is outputted from the reference voltage generating circuit in FIG. 2.

If the first variable resistor unit is selected by the selection signals F_SEL, F_SELb and the decoded signal TRIM2 for trimming is activated, the first resistors for generating the reference voltage (see, Ra in FIG. 5) become the resistors R1, R2_1, R2_2 and the second resistors (see, Rb in FIG. 5) become the resistors R2_3–R2-8.

Continuously referring to FIG. 8, it will be described for the operation of the fuse box 100 and the fuse decoder 200.

First, the fuse box 100 includes the first unit fuse set 110 for outputting the selection signal and the plurality of the second fuse sets 120–140 for outputting the coded signals F0–F2, F0*b*–F2*b*.

In order to select one of the first variable resistor unit 400 and the second variable resistor unit 500 for trimming the reference voltage on the wafer level, it is determined if the selection fuse fs in the first unit fuse set 110 is to be blown. To select the first variable resistor unit 400, the selection signal F_SEL is outputted as the high level to radiate a laser onto the selection fuse fs. To select the second variable resistor unit 500, the selection signal F_SELb is outputted as the high level to blow the selection fuse fs.

In turn, the laser is selectively radiated onto the coding fuses f0–f2 in the second unit fuse sets 120–140 to blow out. Accordingly, the coded signals F0–F2, F0*b*–F2*b* are outputted and decoded by the fuse decoder 200 to activate one of the decoded signals TRIM0–TRIM7 to the high level.

The one node of one of the serially coupled resistors R2_1–R2_8, R3_1–R3_8 in the first variable resistor unit 400 and the second variable resistor unit 500 is connected to the node x depending on the activated one of the decoded signals TRIM0–TRIM7 and the reference voltage Vref is adjusted depending on the resistor that is connected to the node x among the resistors R2_1–R2_8.

Accordingly, When the reference voltage generating circuit includes the first and the second variable resistor units 400, 500 and the resistances of the resistors in the first variable resistor unit 400 are made to be different from those of the resistors in the second variable resistor unit 500, the reference voltages Vref can be trimmed in various ways. That is, not only the range of the trimming for the reference voltage Vref increases but also the reference voltage can be adjusted finely.

On the other hand, the resistances and the number of the resistors included in the first and the second variable resistor units 400, 500 vary depending on the extent to which the reference voltage Vref is to be trimmed. If the reference voltage Vref is to be trimmed in a wide rage by using one of the variable resistor units 400, 500, the number of the resistors should be increased very much.

For example, if the reference voltage Vref is to be trimmed by 0.01 V with one of the resistors, about 50 resistors should be included to trim the reference voltage Vref by 0.5V. Due to this, the fuse box 100 and the fuse decoder 200 are to be much more complicated. At this point, if the voltage range of the reference voltage Vref to be trimmed by one resistor is raised, the number of resistors decreases but the reference voltage Vref cannot be adjusted finely.

In the reference voltage generating circuit of the present invention comprising the first variable resistor unit 400 and the second variable resistor unit 500, if the resistance of each resistor in the first variable resistor unit 400 is chosen to trim the reference voltage Vref by 0.01V and the resistance of each resistor in the second variable resistor unit 500 is chosen to trim the reference voltage Vref by 0.1V, the reference voltage Vref can be trimmed finely and the trimming range for the reference voltage Vref can be increased.

Further, the number of the resistors included in the first variable resistor unit 400 and the second variable resistor unit 500 is as same as that of the resistors included in the variable resistor units in the prior art. Therefore, the area of the fuse decoder 200 and the fuse box 100 is as same as that of the circuit in the prior art. The only added circuits are the selecting unit 600 for selecting one of the first and the second variable resistor units 400, 500 in the fuse box 100 and the first unit fuse set 100 having the selection fuse fs in the fuse box 100, which would increase the circuit area slightly.

Figure 10:
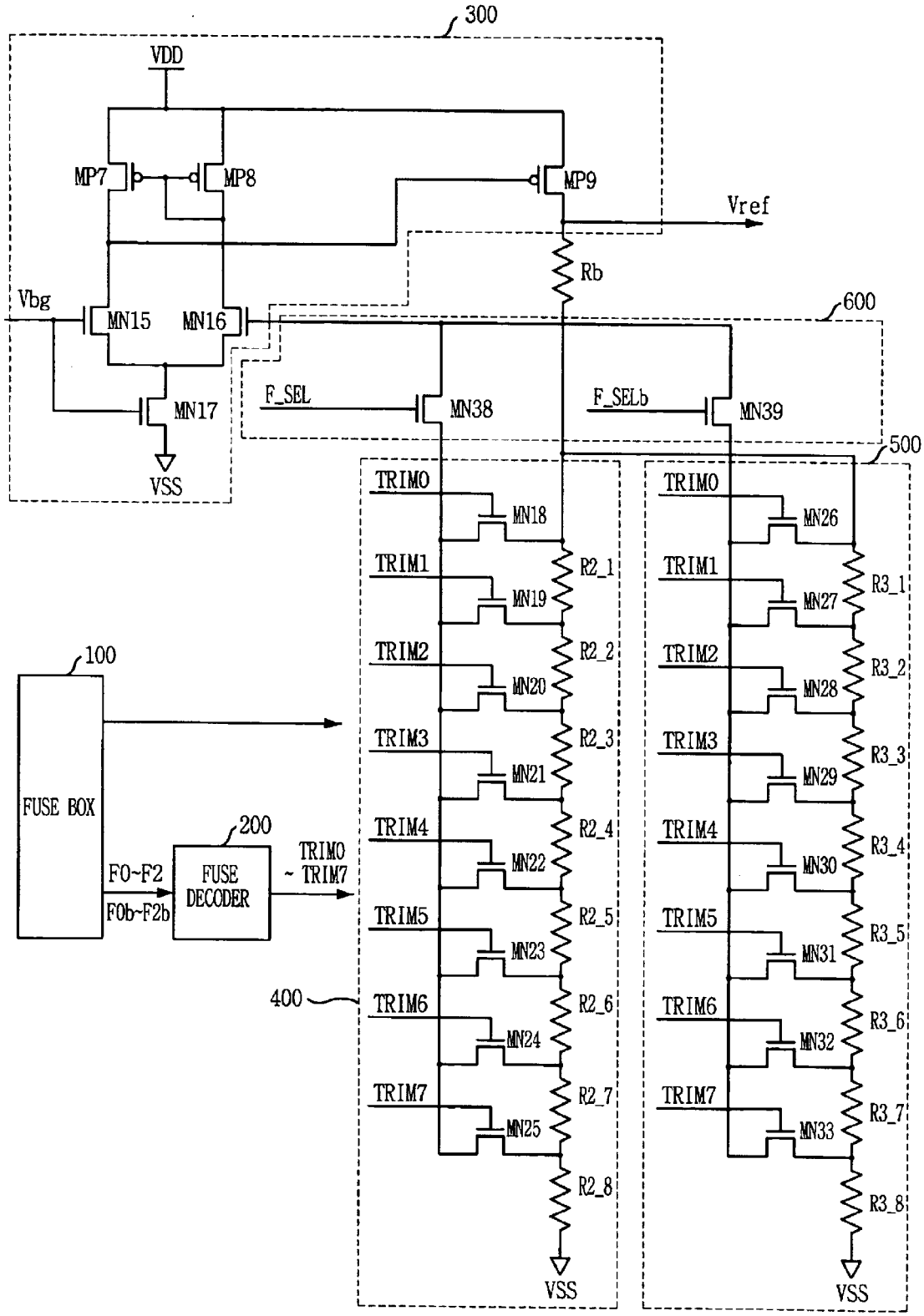
FIG. 10 is a circuit diagram of another embodiment of the reference voltage generating circuit in FIG. 6.

FIG. 10 is a circuit diagram of another embodiment of the reference voltage generating circuit in FIG. 6.

The reference voltage generating circuit of the embodiment shown in FIG. 10 has same constitution as that in FIG. 7 except for a selecting unit 600'.

Referring to FIG. 10, the selecting unit 600' includes MOS transistor MN38 turned on when the selection signal F_SEL becomes the high level to transfer the first trimming voltage Vt1 to the negative input (–) of the operational amplifier 300, and MOS transistor MN39 turned on when the selection signal F_SELb becomes the high level to transfer the second trimming voltage Vt2 to the negative input (–) of the operational amplifier 300.

The operation of the reference voltage generating circuit according to the embodiment shown in FIG. 10 is similar to that of the embodiment shown in FIG. 7 and its detailed description will be omitted for the sake of simplicity.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A reference voltage generating circuit comprising:

voltage outputting means for outputting a reference voltage corresponding to a difference between a band gap reference voltage and an input voltage;

a first resistor having one end that is coupled to the output of the voltage outputting means;

first variable resistor means having a plurality of second resistors that are serially coupled between the first resistor and a ground voltage, for providing the input voltage of the voltage outputting means with a first trimming voltage that is inputted to one and of selected one of the plurality of the second resistors in response to decoded signals for trimming the reference voltage;

second variable resistor means coupled in parallel with the first variable resistor means and having a plurality of third resistors coupled serially between the first resistor and the ground voltage, the third resistors having different resistances from the second resistors, for providing the input voltage of the voltage outputting means with a second trimming voltage that is inputted to one end of selected one of the plurality of the third resistors in response to the decoded signals for trimming the reference voltage; and selecting means for selectively providing the first trimming voltage or the second trimming voltage to the input voltage of the voltage outputting means.

2. The reference voltage generating circuit of claim 1, wherein the voltage outputting means is an operational amplifier.

3. The reference voltage generating circuit of claim 2, further comprising:

a fuse box having a number of fuses for outputting coded signals that are coded by selectively blowing the fuses out; and a fuse decoder for decoding the coded signals from the fuse box to output the coded signals.

4. The reference voltage generating circuit of claim 3, wherein the fuse box includes:

a first unit fuse set having a selection fuse for outputting a selection signal to select the first trimming voltage or the second trimming voltage in the selecting means depending on the blowing out of the selection fuse; and a plurality of second unit fuse sets, each having a coding fuse for outputting one bit signal in the coded signals depending on the blowing out of the coding fuse.

5. The reference voltage generating circuit of claim 4, wherein the first unit fuse set includes:

a first PMOS transistor having one end coupled to the supply voltage, a gate receiving a ground voltage, and the other end coupled to the selection fuse;

a first inverter having an input coupled to the other end of the selection fuse;

a first NMOS transistor connecting the other end of the selection fuse to the ground voltage and having a gate for receiving the output voltage of the first inverter;

a second inverter for inverting the output signal of the first inverter to output a first selection signal for selecting the first trimming voltage in the selecting means; and a third inverter for inverting the output of the second inverter to output a second selection signal for selecting the second trimming voltage in the selecting means.

6. The reference voltage generating means of claim 5, wherein each of the second unit fuse sets includes:

a second PMOS transistor having one end coupled to the supply voltage, a gate for receiving the ground voltage, and the other end coupled to the coding fuse;

a fourth inverter having an input coupled to the other end of the coding fuse;

a second NMOS transistor connecting the other end of the coding use to the ground voltage and having a gate for receiving the output voltage of the fourth inverter;

a fifth inverter for inverting the output signal of the fourth inverter for outputting a first coding signal that is one bit of the coding signals; and a sixth inverter for inverting the output of the fifth inverter for outputting a second coding signal that is inverted version of the first coding signal.

7. The reference voltage generating circuit of claim 4, wherein the fuse decoder includes a plurality of logic AND means, each for receiving a signal from a corresponding one of the plurality of the second fuse sets that is selected from the first coding signal and the second coding signal that are outputting from the corresponding one of the second fuse Sets and for outputting a signal that is one bit of the decoded signals.

8. The reference voltage generating circuit of claim 2, wherein the first variable resistor unit include:

the plurality of the second resistors coupled serially between the first resistor and the ground voltage; and a plurality of switching means turned on in response to the one bit of the decoded signals, respectively, for providing the one end of each of the plurality of the second resistors with the first trimming voltage.

9. The reference voltage generating circuit of claim 2, wherein the selecting means includes:

a first transfer gate turned on in response to a first level of a selection signal for transferring the first trimming voltage to the negative input of the operational amplifier; and a second transfer gate turned on in response to a second level of the selection signal for transferring the second trimming voltage to the negative input of the operational amplifier.

10. The reference voltage generating circuit of claim 2, wherein a selecting means includes:

a first MOS transistor turned on in response to a first level of a selection signal for transferring the first trimming voltage to the negative input of the operational amplifier; and a second MOS transistor turned on in response to a second level of the selection signal for transferring the second trimming voltage to the negative input of the operational amplifier.

11. The reference voltage generating circuit of claim 2, wherein the operational amplifier includes:

a first diode-coupled PMOS transistor having one end coupled to a supply voltage, and a gate coupled to the other end;

a second PMOS transistor having one end coupled to the supply voltage, and a gate coupled to the gate of the first PMOS transistor to form a current mirror with the first PMOS transistor;

a first NMOS transistor having a gate for receiving the band gap reference voltage, and the other end coupled to the other end of the second PMOS transistor;

a second NMOS transistor having one end coupled to the other end of the first PMOS transistor, and a gate for receiving the voltage that is provided from the selecting means;

a third NMOS transistor connecting the other ends of the first and the second NMOS transistors to the ground voltage, and having a gate for receiving the band gap reference voltage; and a third PMOS transistor having one end coupled to the supply voltage, a gate for receiving the voltage that is inputted to the one end of the first NMOS transistor, and the other end for outputting the reference voltage.

12. The reference voltage generating circuit of claim 2, wherein the plurality of resistors included in the second variable resistor means have 1/10–1/5 resistance compared to the resistances of the plurality of resistors included in the first variable resistor means.

* * * * *

UNITED STATES PATENT AND TRADEMARK OFFICE

CERTIFICATE OF CORRECTION

PATENT NO. : 6,949,971 B2
APPLICATION NO. : 10/746494
DATED : September 27, 2005
INVENTOR(S) : Jang It is certified that error appears in the above-identified patent and that said Letters Patent is hereby corrected as shown below:

In Claim 3, Col. 10, Ln 56, please delete "coded" and insert -- decoded --.

Signed and Sealed this

Second Day of June, 2009

JOHN DOLL
*Acting Director of the United States Patent and Trademark Office*